US005391075A

United States Patent [19]

Robinson et al.

[11] Patent Number: 5,391,075

[45] Date of Patent: Feb. 21, 1995

[54] MULTI-FUEL BURNER

[76] Inventors: Edgar C. Robinson, 2791 E. 23rd Avenue, Vancouver, British Columbia, Canada, V5R 1A7; Leonard Fleming, 205 - 4733 River Road West, Delta, British Columbia, Canada, V4K 1R9

[21] Appl. No.: 89,763

[22] Filed: Jul. 9, 1993

[51] Int. Cl.[6] ..... F23Q 7/06

[52] U.S. Cl. ..... 431/258; 431/350; 431/188

[58] Field of Search ..... 431/258, 350, 9, 116, 431/188, 115, 354

[56] References Cited

U.S. PATENT DOCUMENTS

| | | | |
|---|---|---|---|
| Re. 28,679 | 1/1976 | Robinson | 431/9 |
| 3,875,477 | 4/1975 | Fredriksson et al. | 317/98 |
| 4,703,888 | 11/1987 | Kawamura | 431/258 X |
| 5,102,328 | 4/1992 | Robinson | 431/116 |

OTHER PUBLICATIONS

Advertising brochure of the Norton Company entitled "Norton Hot Surface Igniters"; date unknown.

*Primary Examiner*—Larry Jones
*Attorney, Agent, or Firm*—John Russell Uren

[57] ABSTRACT

A burner has a burner tube and a nozzle holder mounted in one end of the burner tube. An igniter is positioned within the nozzle holder and acts to ignite any of the multi-liquid fuels which may be used with the burner. A nozzle emits atomized liquid fuel under the venturi effect of the nozzle with compressed air being supplied to the nozzle. Primary air holes extend circumferentially around the nozzle holder to admit air radially which passes directly to the burner tube. Secondary air holes extend around the inside circumference of the burner tube on the secondary air injection plate and admit air axially to the burner tube.

9 Claims, 3 Drawing Sheets

MULTI-FUEL BURNER

INTRODUCTION

This invention relates to a multi-fuel burner and, more particularly, to a multi-liquid fuel burner utilizing an igniter and a nozzle holder which emits atomized fuel.

BACKGROUND OF THE INVENTION

It is desirable in many applications to have a burner which will operate using a plurality of fuels. Such a burner is described and claimed in Reissue U.S. Pat. No. 28,679 naming the same inventor as named in the present application. The use of a multi-fuel burner is desirable because it may be operated with fuel as is readily available in the operating environment where the burner is utilized. For example, in the high north, construction and mining equipment may operate with diesel fuel. It is convenient to use such a fuel for operating the burner.

The burner illustrated and disclosed in Reissue U.S. Pat. No. 28,679 and in U.S. Pat. No. 5,102,328, however, utilize in the first instance a round flame grid and, in the second instance, a cylindrical flame grid which are convenient for the particular applications under which they may be used. In other applications, however, it is convenient to utilize a flame grid having a different configuration which may be designed and manufactured for far less expense and which may be used, for example, for water heating and for oven heating, which oven may be used in a field kitchen by the military. A furnace may also utilize the burner which furnace distributes the hot air by using appropriate ducting.

Heretofore, the multi-fuel burner according to the aforementioned patents has used an ignition electrode to provide for the initial combustion of the atomized liquid fuel which is emitted from the nozzle by the venturi action of the primary air in the nozzle. Ignition electrodes, however, have a gap in which the distance is critical. The tips of such electrodes can also burn off until the electrode eventually becomes inoperable and a relatively high amount of power is required to form the spark on the electrode. Thus, relatively high maintenance is required to keep the ignition electrode in optimum condition and replacement is, of course, required from time to time.

Although igniters have been used with gaseous systems such as propane as described in U.S. Pat. No. 3,875,477, it has not been contemplated that an igniter may be used with atomized liquid fuels. Although propane is stored in a liquid form, when the pressure is released on the liquid, the propane is ejected by the nozzle in gaseous form. The propane will be ignited when it passes over the igniter.

The place of introduction of secondary air is important. For example, if it is desired that combustion occur on an external grid rather than internally of the burner tube, the secondary air is added at a location where it supports combustion on the grid and not within the burner tube.

SUMMARY OF THE INVENTION

According to one aspect of the invention, there is provided a burner having a burner tube, a nozzle holder operably connected to said burner tube, a nozzle operably inserted in one end of said nozzle holder to eject atomized liquid fuel from said nozzle, and an igniter mounted in said nozzle holder such that said igniter is in the path of atomized liquid fuel emitted from said nozzle, a secondary air injection plate located between said nozzle and said burner tube, said secondary air injection plate having secondary air holes allowing air to enter said burner tube at a location different from the location said atomized liquid fuel enters said burner tube.

According to a further aspect of the invention, there is provided a burner having a burner tube, a rectangular flame grid being positioned so as to direct a flame on said grid upwardly when said grid is in a horizontal position, a nozzle holder having primary air holes located around the circumference of said nozzle holder, a nozzle and an igniter operably mounted in said nozzle holder, said igniter being mounted in said nozzle holder in a position where atomized liquid fuel emitted by said nozzle passes over said igniter, said primary air holes allowing primary air to radially enter said nozzle holder and pass directly from said air holes into said burner tube and a baffle plate located between the end of said burner tube and said flame grid and so said atomized liquid fuel passes therethrough.

According to yet further aspect of the invention, there is provided a burner having a burner tube, secondary air inlet holes surrounding in the inside circumference of one end of said burner tube closest to said nozzle, said secondary air holes allowing secondary air to axially enter said burner tube, a nozzle holder mounted to said one end of said burner tube, a nozzle and an igniter mounted in said nozzle holder, said igniter being mounted in a position such that atomized liquid fuel emitted from said nozzle passes over said igniter, and a plurality of primary air inlet holes operable to allow the radial ingress of air to said nozzle holder and the passage of said radially and inwardly directed air directly to said burner tube.

BRIEF DESCRIPTION OF THE SEVERAL VIEWS OF THE DRAWINGS

Specific embodiments of the invention will now be described by example only, with the use of drawings in which.

DESCRIPTION OF SPECIFIC EMBODIMENT

Figure 1:
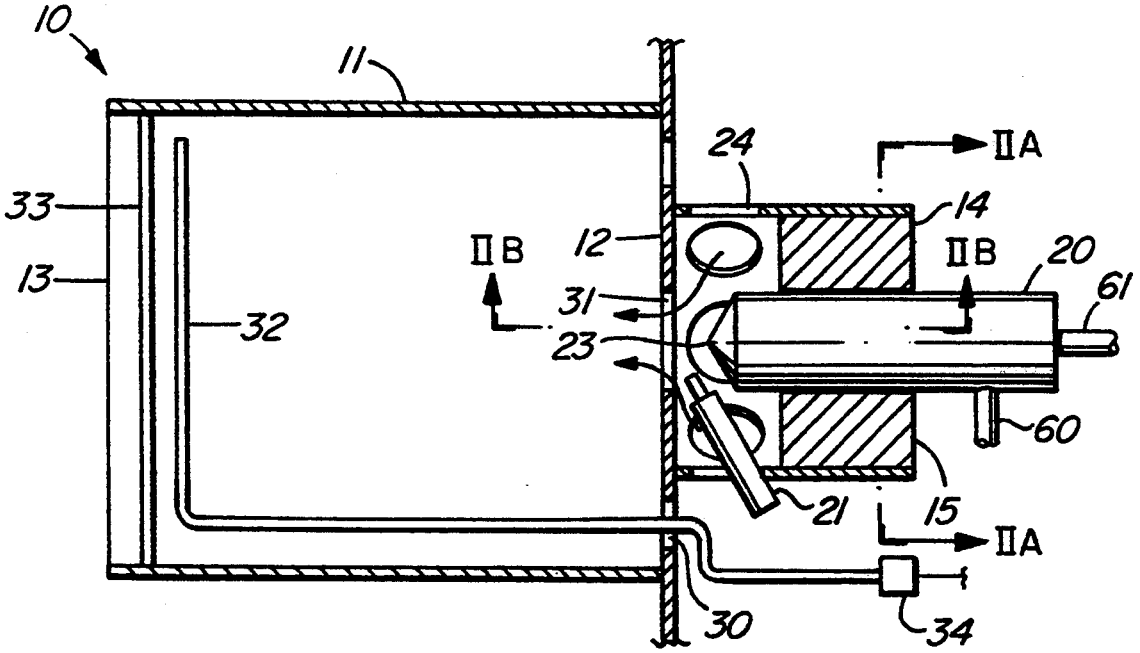
FIG. 1 illustrates a burner according to the invention having a burner tube in which combustion takes place with a nozzle holder connected to the end of the burner tube in accordance with the present invention.

Referring now to the drawings, a burner according to the invention is generally illustrated at 10 in FIG. 1. It comprises a burner tube 11 with one end having a closed secondary air injection plate 12. The opposite end 13 of the burner tube 11 is open.

The secondary air injection plate 12 is operably connected to a nozzle holder 14. Nozzle holder 14 is adapted to allow the mounting of a nozzle 20 in one end 15 of the nozzle holder 14 and also to allow an igniter 21 to be mounted on an inclined radial to the nozzle holder 14 as is illustrated. A typical igniter that may be utilized in this application is a NORTON hot surface igniter and, in particular, the NORTON Model 301 igniter. The igniter 21 has a tip 22 which is located a distance from the apex 23 of the nozzle 20 such that when atomized liquid is emitted from the nozzle 20, the tip 22, when heated, allows the atomized fuel to be ignited as will be described.

A plurality of circumferential holes 24, conveniently eight(8) in number, are located about the periphery of the nozzle holder 14 and allow primary air to enter the nozzle holder 14 and to proceed directly, without diversion, to the burner tube 11 as is indicated by the arrows.

A plurality of circumferential secondary air holes 30 are located about the inside circumference of the burner tube 11 and are drilled through the secondary air injection plate 12 in the positions illustrated. A central circumferential aperture 31 allows ingress of the atomized fuel from the nozzle 20 into the burner tube 11 where combustion occurs.

A flame rod 32 is located in the burner tube 11 and is operable to pass current between the flame rod 32 and ground 33 operably mounted across the burner tube 11 so as to indicate the presence or absence of a flame. A voltage source 34 supplies the necessary power to the flame rod 32.

Nozzle 20 has a source of liquid fuel 60 which is provided to the nozzle 20. Compressed air is also provided to the nozzle 20 through a compressed air line 61.

OPERATION

In operation, the igniter 21 is switched on and tip 22 immediately heats to a temperature which will ignite the atomized liquid being emitted from the apex 23 of nozzle 20 under the suction or venturi effect of the compressed air entering line 61 and leaving nozzle 20. The atomized liquid fuel which may be gasoline, jet fuel, waste oil, diesel fuel, heating oil or the like is ignited by the tip 22 of the guide 21 and pass through the centrally located circumferential aperture 31 where combustion takes place within the burner tube 11. Following the ignition of the atomized fuel in the burner tube 11 and the increase in temperature of the burner tube 11 to allow the combustion to be self sustaining, the igniter 21 will terminate operation. The flame rod 32 senses the presence of a flame in the burner tube 11 as is known. In the event no flame is present, the flame rod 32 will immediately act to shut down the burner 10.

The primary air passes radially through the circumferential primary air holes 24 from the atmosphere. It then passes directly to the burner tube 11 as is illustrated by the arrows in FIG. 1. The secondary air passes axially through the secondary air holes 30 on the secondary air injection plate 12 and act to support combustion within the burner tube 11.

Figure 2A:
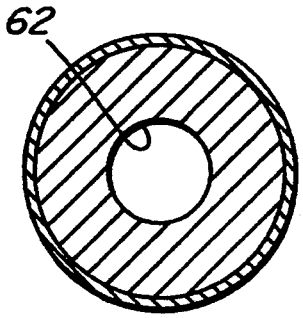
FIGS. 2A and 2B are sectional and end views of the nozzle holder according to the invention taken along IIA and IIB of FIG. 1, respectively.
Figure 2B:
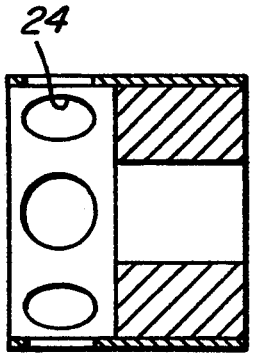

The nozzle holder 14 is shown in more detail in FIGS. 2A and 2B. A hole 62 is machined in the nozzle holder 14 to allow the nozzle 20 (FIG. 1) to be held by the nozzle holder 14. The primary air holes 24 are located about the circumference of the nozzle holder 14 and are used to allow primary air to radially enter into the nozzle holder 14 and, thence, to pass directly to the burner tube 11.

Figure 4A:
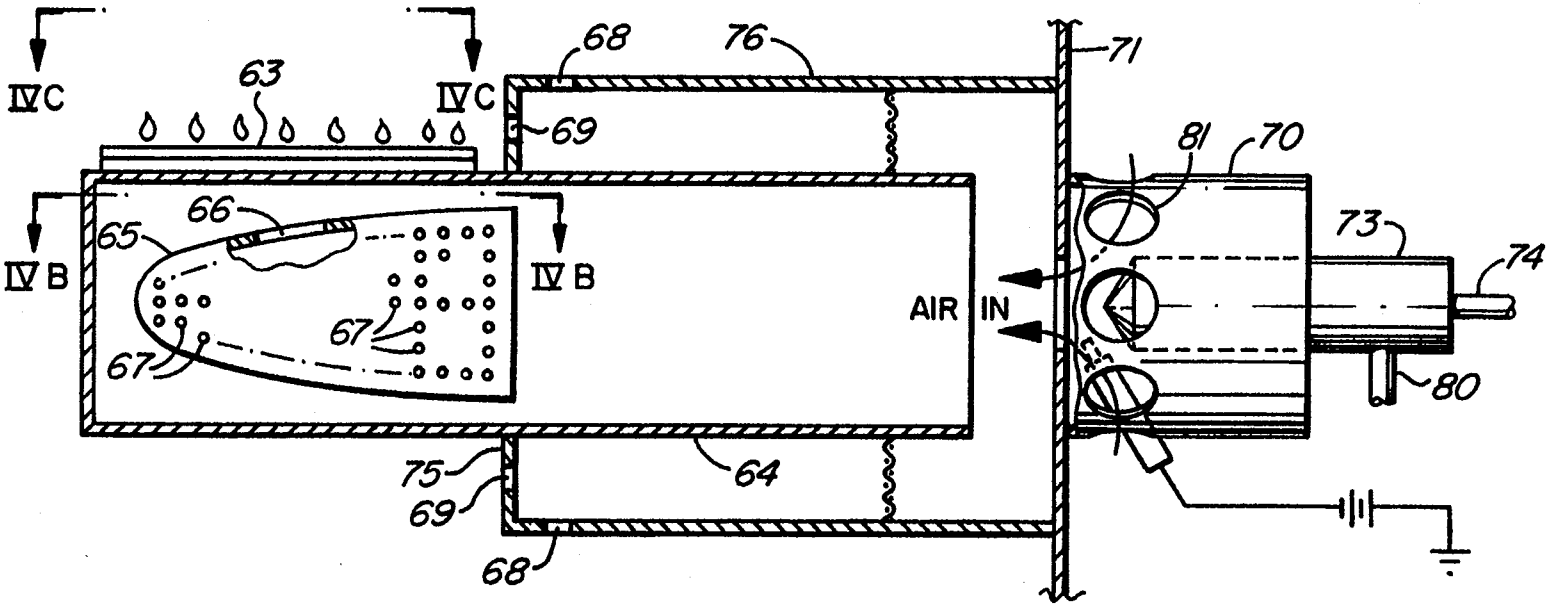
FIG. 4A is a view of the burner according to the invention utilizing a rectangular flame grid and baffle in a furnace or oven heating application.
Figure 4C:
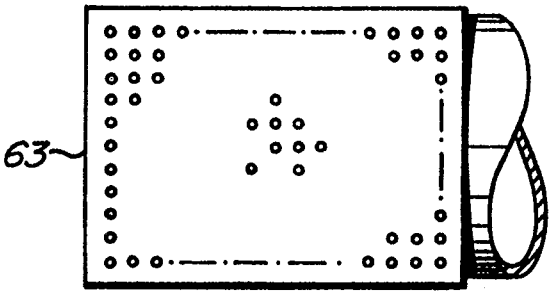
FIG. 4C is a plan view of the rectangular flame grid of the burner according to FIG. 4A.
Figure 4B:
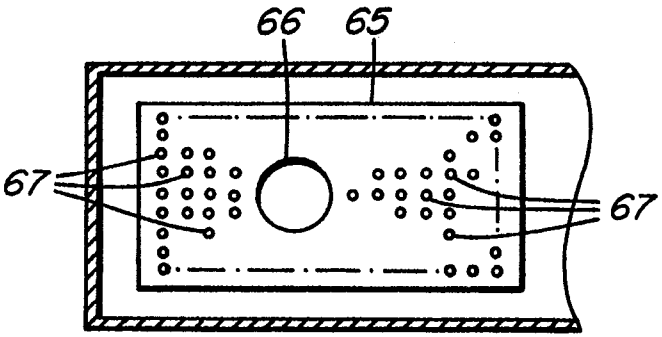
FIG. 4B is a view of the baffle within the burner tube taken along IVB—IVB of FIG. 4A.

A further embodiment of an apparatus with which the burner according to the invention is used is illustrated in FIGS. 4A, 4B and 4C. This embodiment is used, for example, where it is desired to heat an oven such as a stove in a field kitchen as might be used by the military and the like. In this case, the air injection plate 71 will have no secondary holes surrounding the nozzle holder 70 and the burner tube 64 will be located a distance away from the air injection plate 71 as is illustrated. A rectangular or square flame grid 63 faces upwardly and is connected to one end of the burner tube 64. A U-shaped baffle 65 is positioned within the burner tube 64 so that the fuel passes through the baffle 65 on the way to the rectangular grid 63. The baffle 65 has a centrally located pilot hole 66 and a plurality of holes 67 to allow passage of the fuel to the grid 63. The nozzle holder 70 is mounted directly to the injection plate 71 and, upon the tip of the igniter 72 igniting the atomized fuel being ejected from the nozzle 73 under the influence of air being provided through the compressed air line 74 and the liquid fuel being provided through fuel line 80, primary air enters the primary air holes 81 and passes directly to the burner tube 64 to support combustion on flame grid 63. It will be particularly noted that no secondary air holes are provided in the injection plate 71 because the combustion is not taking place within the burner tube 64 but, rather, on the rectangular flame grid 63. However, secondary air intake holes 68, 69 are located in the jacket 76 surrounding the burner tube 64 about the outside circumference of the jacket 76 and the circumference of the end 75 of the jacket 76, respectively.

Figure 3:
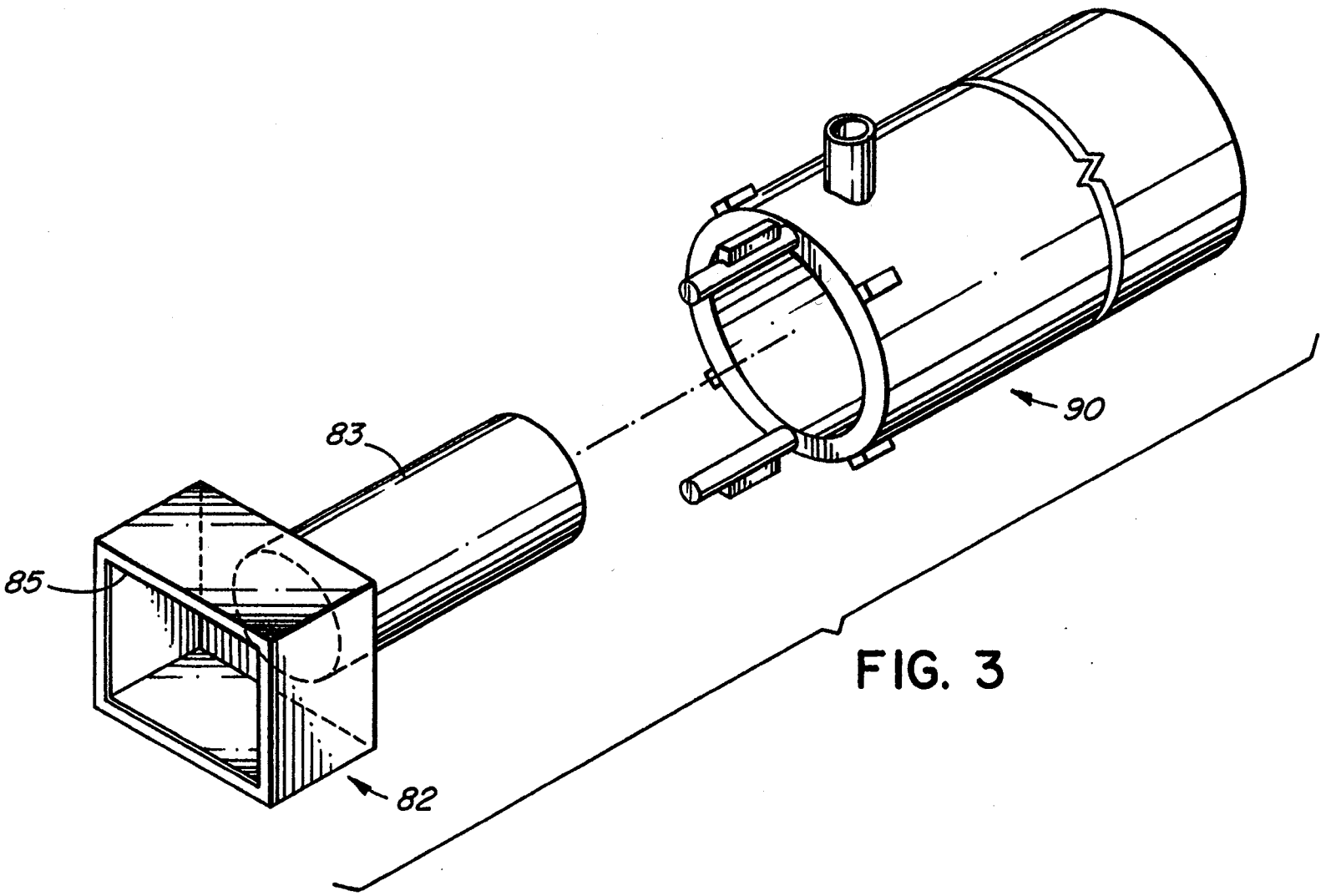
FIG. 3 is an exploded view of several of the operating components of a hot water heater into one end of which is inserted a burner according to FIG. 1.

A further embodiment of the invention is shown in FIG. 3 which illustrates several operating components of a hot water heater. The burner according to the invention as illustrated in FIG. 1 is inserted directly into the end 85 of the housing generally shown at 82. The burner tube 11 (FIG. 1) extends into cylinder 83 and cylinder 83, in turn, extends into the water jacket generally illustrated at 84.

In operation, and upon initial combustion of the atomized fuel within burner tube 11, the cylinder 83 will be heated. Cylinder 83 will provide heat to the water jacket 90 and the water will be heated.

Instead of a flame rod 32, a photocell could be used which senses the presence or absence of a flame in the burner tube 11.

While specific embodiments have been described, such descriptions should be taken as illustrative of the invention only and not as limiting its scope. Many modifications will readily occur to those skilled in the art to which the invention relates and, therefore, the scope of the invention should properly be construed in accordance with the accompanying claims.

What is claimed is:

1. A burner having a burner tube, a nozzle holder operably connected to said burner tube, a nozzle operably inserted in one end of said nozzle holder to eject atomized liquid fuel from said nozzle, an igniter mounted in said nozzle holder such that said igniter is in the path of atomized liquid fuel emitted from said nozzle, a secondary air injection plate located between said nozzle and said burner tube, said secondary air injection plate having secondary air holes allowing air to enter said burner tube at a location different from the location said atomized liquid fuel enters said burner tube.

2. A burner as in claim 1 and further comprising primary air holes positioned about the circumference of said nozzle holder to allow primary air to radially enter said nozzle holder and to pass directly to said burner tube.

3. A burner as in claim 2 wherein said secondary air holes are positioned outside the circumference of said nozzle holder in said secondary air injection plate, said secondary air holes allowing air to axially enter said burner tube.

4. A burner as in claim 2 and further comprising a flame grid connected to the end of said burner tube.

5. A burner as in claim 4 and further comprising a baffle mounted between the end of said burner tube and said flame grid.

6. A burner as in claim 5 wherein said flame grid is rectangular.

7. A burner as in claim 1 wherein said atomized fuel is diesel fuel or heating oil.

8. A burner having a burner tube, a rectangular flame grid being positioned so as to direct a flame on said grid upwardly when said grid is in a horizontal position, a nozzle holder having primary air holes located around the circumference of said nozzle holder, a nozzle and an igniter operably mounted in said nozzle holder, said igniter being mounted in said nozzle holder in a position where atomized liquid fuel emitted by said nozzle passes over said igniter, said primary air holes allowing primary air to radially enter said nozzle holder and pass directly from said air holes into said burner tube and a baffle plate located between the end of said burner tube and said flame grid so said atomized liquid fuel passes therethrough.

9. A burner having a burner tube, secondary air inlet holes in the inside circumference of one end of said burner tube closest to said nozzle, said secondary air holes allowing secondary air to axially enter said burner tube, a nozzle holder mounted to said one end of said burner tube, a nozzle and an igniter mounted in said nozzle holder, said igniter being mounted in a position such that atomized liquid fuel emitted from said nozzle passes over said igniter, and a plurality of primary air inlet holes operable to allow the radial ingress of air to said nozzle holder and the passage of said radially and inwardly directed air directly to said burner tube.

* * * * *